US008678163B2

(12) United States Patent
Tanaka et al.

(10) Patent No.: US 8,678,163 B2
(45) Date of Patent: Mar. 25, 2014

(54) PAPER CURRENCY HANDLING APPARATUS AND METHOD OF DEPOSITING PAPER CURRENCIES USING SAME

(75) Inventors: Shuuji Tanaka, Yokohama (JP); Atsuko Uozumi, Owariasahi (JP); Masayasu Ueno, Nagakute (JP)

(73) Assignee: Hitachi-Omrom Terminal Solutions, Corp., Tokyo (JP)

( * ) Notice: Subject to any disclaimer, the term of this patent is extended or adjusted under 35 U.S.C. 154(b) by 0 days.

(21) Appl. No.: 13/524,572

(22) Filed: Jun. 15, 2012

(65) Prior Publication Data

US 2013/0015035 A1 Jan. 17, 2013

(30) Foreign Application Priority Data

Jul. 15, 2011 (JP) ..... 2011-156255

(51) Int. Cl.
*G07F 7/04* (2006.01)

(52) U.S. Cl.
USPC ..... 194/206; 194/342

(58) Field of Classification Search
USPC ..... 194/206, 342, 343, 344, 350, 351; 49/35; 312/140.3
See application file for complete search history.

(56) References Cited

U.S. PATENT DOCUMENTS 5,199,697 A * 4/1993 Yamada et al. ..... 271/122
2006/0144922 A1 7/2006 Park et al.

FOREIGN PATENT DOCUMENTS

EP 1926057 A1 5/2008
JP 2008-097241 A 4/2008

OTHER PUBLICATIONS

"Bill Deposit Gate for Teller Auto-Cashier", IBM Technical Disclosure Bulletin, International Business Machines Corp. Arkmonk, NY, USA, vol. 30, No. 12, May 1, 1988, pp. 22-23.

* cited by examiner

*Primary Examiner* — Mark Beauchaine
(74) *Attorney, Agent, or Firm* — Mattingly & Malur, PC

(57) ABSTRACT

A paper currency handling apparatus associated with the present invention has a paper currency storage unit which receives paper currencies, a feeder port which enters or dispenses paper currencies by opening or closing an inner shutter and an outer shutter, a transport path which transports the paper currencies between the feeder port and the paper currency storage unit, open/close control unit which controls open/close operations of the inner shutter and the outer shutter independently, and paper currency posture modification unit which modifies the posture of paper currencies present between the outer shutter and the inner shutter.

3 Claims, 8 Drawing Sheets

PAPER CURRENCY HANDLING APPARATUS AND METHOD OF DEPOSITING PAPER CURRENCIES USING SAME

INCORPORATION BY REFERENCE

The present application claims priority from Japanese application JP2011-156255 filed on Jul. 15, 2011, the content of which is hereby incorporated by reference into this application.

BACKGROUND OF THE INVENTION

The present invention relates to a paper currency handling apparatus for use in an automatic teller machine (ATM) and to a method of depositing paper currencies using the paper currency handling apparatus.

An automatic teller machine (ATM) used in a financial institution or the like generally has a shutter mounted above the feeder slot (cash insert/dispense slot). There exist ATMs which are designed to have a double shutter structure (i.e., outer shutter and inner shutter) to strengthen the security for paper money at the feeder slot. For example, JP-A-2008-97241 discloses a technique of preventing paper money from being taken away due to a shutter fault by mounting a double structure shutter at the feeder slot.

SUMMARY OF THE INVENTION

In the case of a double shutter structure as in the background art, a space is formed between the outer and inner shutters. As a result, depending on how paper currencies are inserted by the user, the paper currencies may be left between the outer and inner shutters. In this case, it is essential that the user withdraw the inserted paper currencies and that they be reinserted in a correct posture. If the user is unfamiliar with ATMs, he or she may not know the correct method of inserting paper money. This creates the problem that paper currencies will not be accepted no matter how many times the user attempts to reinsert the paper currencies.

A paper currency handing apparatus associated with the present invention has a paper currency storage unit which receives paper currencies, a feeder port which inserts or dispenses paper currencies by opening or closing an inner shutter and an outer shutter, a transport path which transports the paper currencies between the feeder port and the paper currency storage unit, open/close control unit which controls open/close operations of the inner and outer shutters independently, and paper currency posture modification unit which modifies posture of paper currencies present between the inner and outer shutters.

Where inserted paper currencies are incorrectly placed in position between the inner and outer shutters, the present invention permits a user to manually modify the posture of the paper currencies. This can reduce the labor required for the user to reinsert the paper currencies in order to modify their posture.

Other objects, features and advantages of the invention will become apparent from the following description of the embodiments of the invention taken in conjunction with the accompanying drawings.

DESCRIPTION OF THE EMBODIMENTS

A paper currency handling apparatus associated with one embodiment of the present invention has a paper currency storage unit which receives paper currencies, a feeder port (cash insert/dispense port) which inserts or dispenses paper currencies by opening or closing an inner shutter and an outer shutter, a transport path which conveys the paper currencies between the feeder port and the paper currency storage unit, open/close control unit which controls open/close operations of the inner and outer shutters independently, and a paper currency posture modification unit which modifies the posture of paper currencies present between the outer and inner shutters. This structure permits paper currencies incorrectly inserted between the outer and inner shutters to be automatically guided into an appropriate location without reinserting the paper currencies.

When the outer and inner shutters are open, the outer shutter is preferably moved to close while keeping the inner shutter open. As the inner shutter is moved to close, the paper currency posture modification unit is preferably loaded between the outer and inner shutters. As the outer shutter is moved to close, the modification unit is preferably unloaded from between the outer and inner shutters.

1. Embodiment Using a Movable Lever

Figure 1:
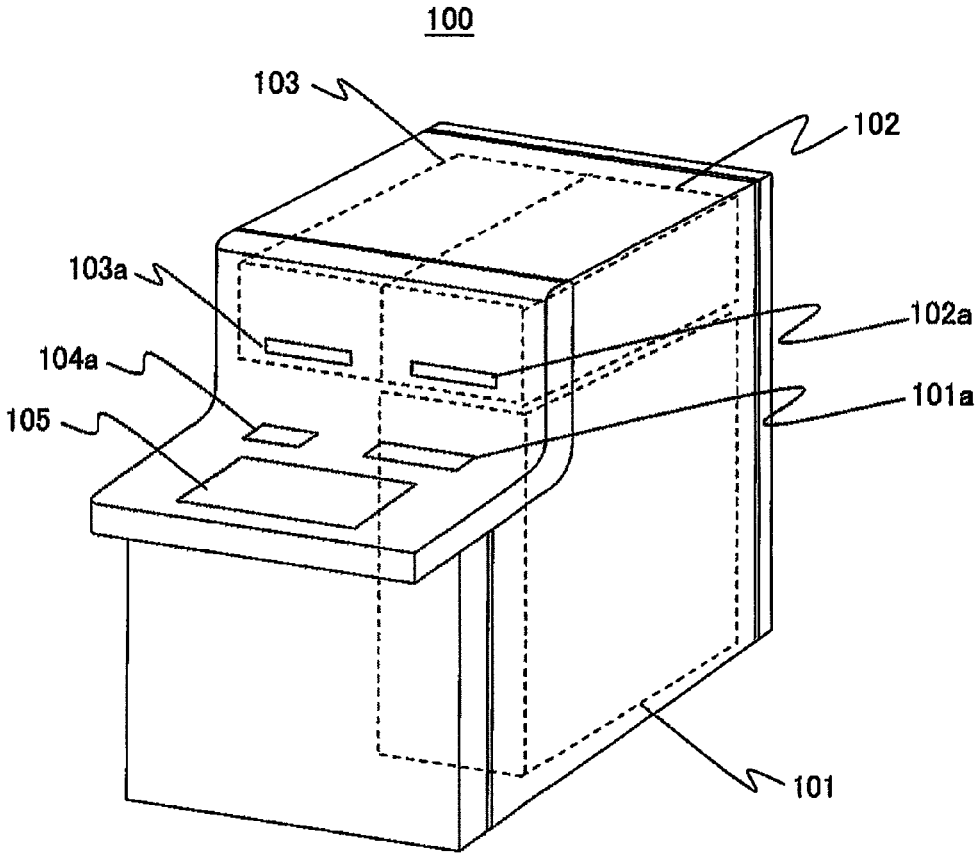
FIG. 1 is a perspective view of an ATM equipped with a paper currency handling apparatus associated with one embodiment of the present invention.
Figure 2:
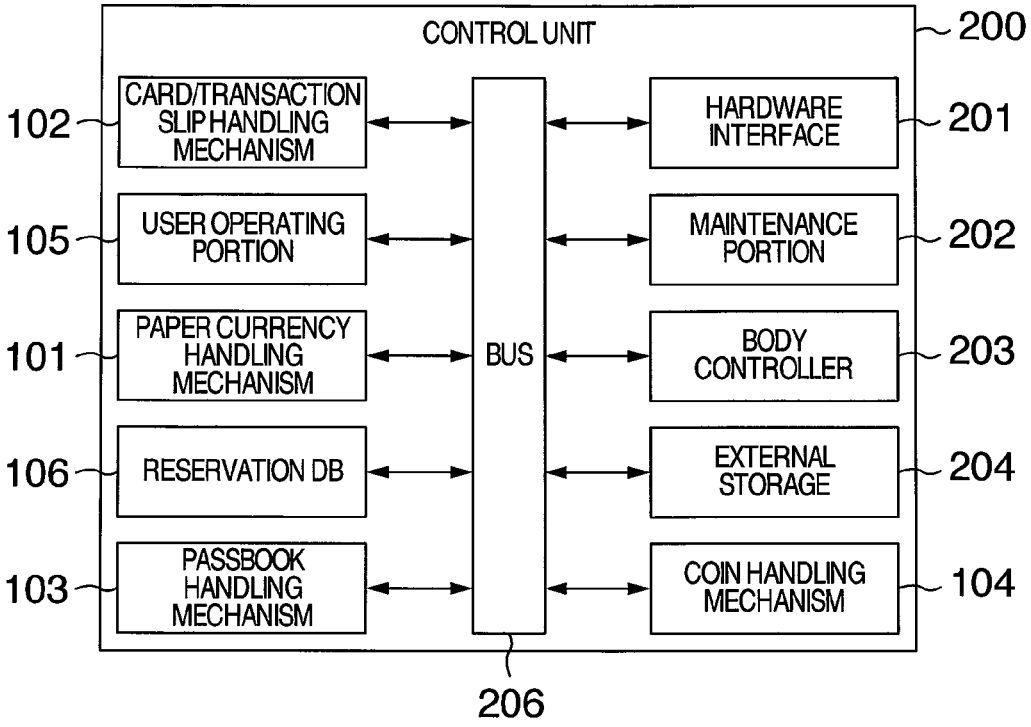
FIG. 2 is a functional block diagram of the paper currency handling apparatus of the ATM shown in FIG. 1.

One embodiment of the present invention is hereinafter described with reference to drawings. FIG. 1 is a perspective view showing the outer appearance of an automatic teller machine (ATM) 100 equipped with a paper currency handling mechanism 101 representing one example of paper currency handling apparatus. FIG. 2 is a block diagram of a control unit 200 of the ATM 100. The ATM 100 is a machine for handling various kinds of processing such as deposits, withdrawals, and bank transfers using various media such as card, paper money, and transaction slip in response to a user's manipulation. The machine 100 has, in its upper portion, a passbook handling mechanism 103 for handling a user's passbook, printing the contents of a transaction, and dispensing the passbook and a card-transaction slip processing mechanism 102 for handling a user's card, printing the contents of a transaction, and dispensing the card. The passbook handling mechanism 103 is in communication with a feeder slot 103*a*, handles the user's passbook inserted in the slot 103*a*, prints the contents of the transaction, and dispenses the passbook. The card-transaction slip handling mechanism 102 is in communication with another slot 102*a*, handles a user's card inserted in the slot 102*a*, prints the specifications of the transaction, and dispenses the card. Furthermore, the ATM 100 has a user operating portion 105 in an upper portion of the front side of the machine. The user operating portion 105 displays the contents of each transaction and permits a user to make inputs or manipulations. A coin handling mechanism 104 (see FIG. 2) representing one example of coin handling device is mounted on the left side of the paper currency handling mechanism 101 of the ATM 100. The coin handling mechanism 104 is in communication with a shutter 104*a* mounted at an upper portion of the front side of the ATM 100 and performs transactions using coins such as insertions and withdrawals of coins. The ATM 100 may dispense with the coin handling mechanism 104.

In addition, the ATM 100 has the paper currency handling mechanism 101 in a right portion of a lower stage. The paper currency handling mechanism 101 has a feeder port (cash insert-dispense port) 30 in communication with a shutter 101*a* mounted in an upper portion of the front side of the ATM 100, and handles transactions associated with paper currencies such as for deposits and withdrawals.

Further, the ATM 100 incorporates the paper currency handling mechanism 101 having a paper currency handling mechanism control unit 301, the card-transaction slip handling mechanism 102, the passbook handling mechanism 103, the coin handling mechanism 104, the user operating portion 105 manipulated by the customer, a reservation DB 106, a body controller 203, a bus 206, a hardware interface 201, a maintenance portion 202, and an external storage 204. The body controller 203 controls the whole processing. That is, the paper currency handling mechanism 101, the card-transaction slip handling mechanism 102, the passbook handling mechanism 103, the coin handling mechanism 104, the user operating portion 105, the reservation DB 106, the hardware interface 201, the maintenance portion 202, and the external storage 204 are connected with the body controller 203 via the bus 206. These components operate under control of the body controller 203. Besides, the body controller 203 is connected with a host computer (not shown) via the interface 201 and can send and transmit necessary data.

The user operating portion 105 has a touch panel on which the contents of manipulations are displayed. The user operating portion 105 accepts user's input operations, for example, for making a choice from deposit, withdrawal, fund transfer, and other types of transactions, and for entering a personal identification number (PIN), a sum of money, and so on, and sends the input signal to the body controller 203. The reservation DB 106 is connected with the body controller 203 and manages paper currencies stored in a cash tray, a cash storage, or the like and the results of authentication of the paper currencies.

The maintenance portion 202 is used by bank personnel or servicemen to operate and service the ATM 100, and has an input portion permitting bank personnel to make manipulations to place a paper currency tray in position and set a given number of paper currencies, as well as a display portion on which the state of the machine, operational mode, the location of a fault if any, and so on are displayed.

The paper currency handling mechanism 101 has the paper currency handling mechanism control unit 301 connected with the body controller 203 via the bus 206. The operation of the paper currency handling mechanism 101 is controlled based on a control signal sent from the body controller 203 to the paper currency handling mechanism control unit 301. Examples of processing operations performed by the paper currency handling mechanism 101 under control of the body controller 203 include counting of entered money, receipt of entered money, and withdrawal of money. The counting of entered money means counting of paper currencies entered by the user into the feeder port to make a deposit. The receipt of entered money means that, when the user makes an affirmative input after counting of money, the paper currencies are received in denomination-specific money trays. The withdrawal of money means that when the transaction is a cash withdrawal, paper currencies having a sum of money and denominations specified by the user are taken from the corresponding denomination-specific money trays and dispensed into the feeder port.

When the user operating portion 105 is manipulated to select a withdrawal as a transaction type, the body controller 203 first gives an instruction to perform an operation for counting entered money. When the counting is complete and the user has made an affirmative input, the body controller gives an instruction to perform an operation for accepting the entered money.

Figure 3:
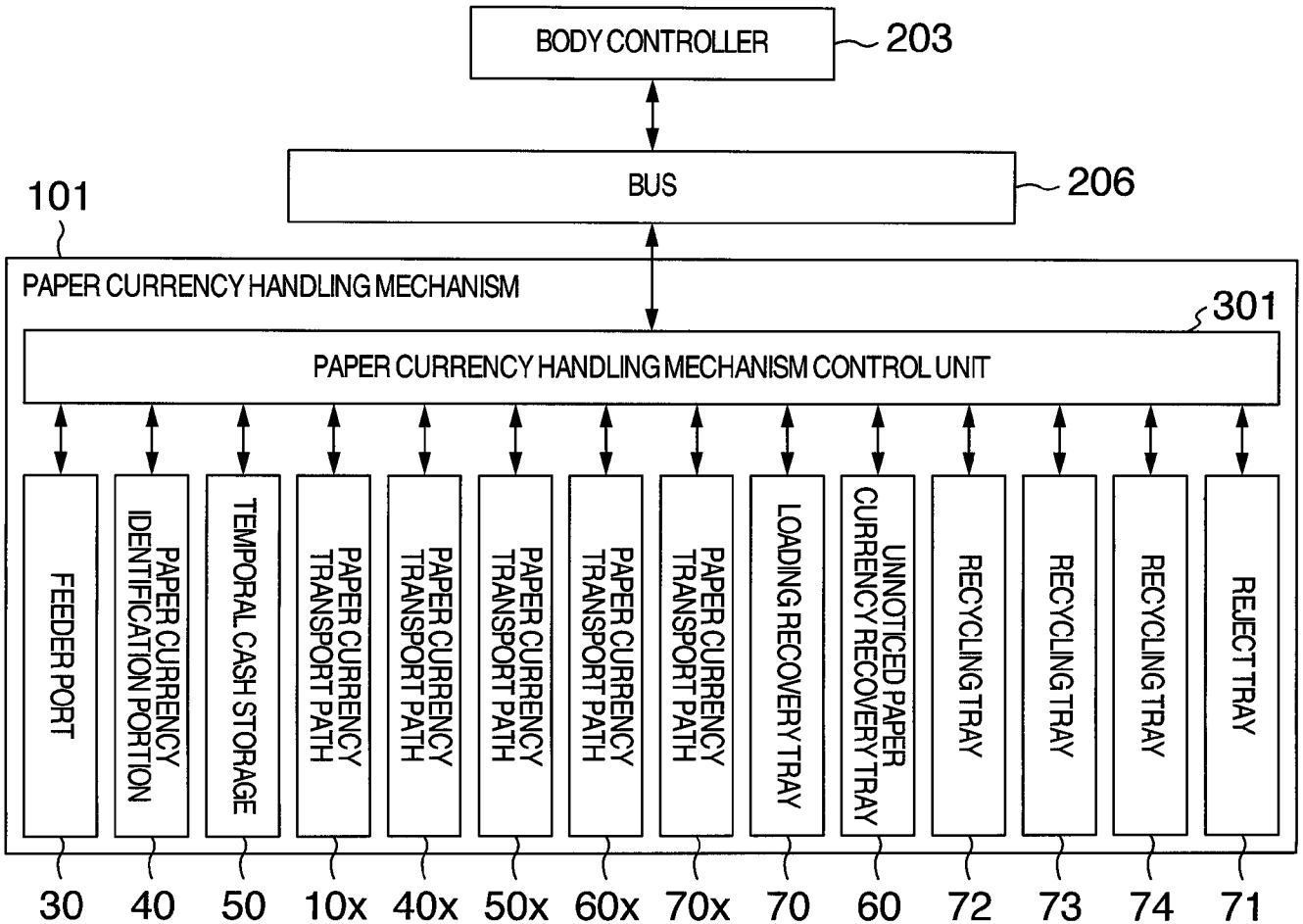
FIG. 3 is a functional block diagram of the paper current handling apparatus of the ATM shown in FIG. 2.

A control structure of the paper currency handling mechanism is next described by referring to FIG. 3, which is a block diagram illustrating the control relationship mainly associated with the paper currency handling mechanism 101.

The paper currency handling mechanism control unit 301 incorporated in the paper currency handling mechanism 101 is connected with the body controller 203 of the ATM 100 via the bus 206, and controls the currency handling mechanism 101 in response to instructions from the body controller 203 and in response to the detected state of the handling mechanism 101. If necessary, information regarding the state of the paper currency handling mechanism 101 is sent to the body controller 203. Inside the currency handling mechanism 101, the paper currency handling mechanism control unit 301 is connected with drive motors, electromagnetic motors, and sensors of the various units (i.e., the feeder port 30 including the outer and inner shutters, a paper currency identification portion 40, a temporal cash storage 50, split money transport paths 10*x*, 40*x*, 50*x*, 60*x*, 70*x*, a loading recovery tray 70, an unnoticed paper currency recovery tray 60, a reject tray 71, and recycling trays 72-74). According to the performed transaction, the paper currency handling mechanism control unit 301 controllably drives actuators while monitoring the state by the sensors.

Figure 4:
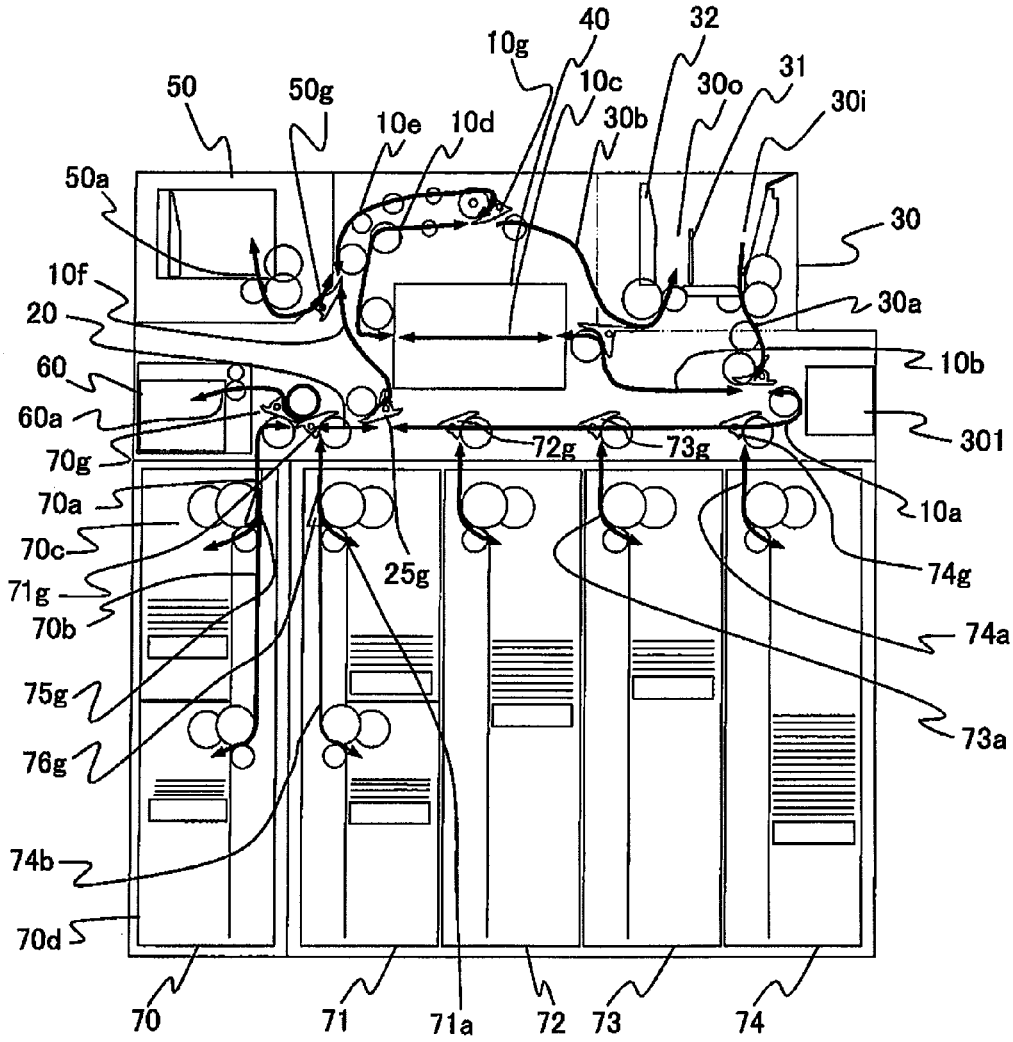
FIG. 4 is a schematic side elevation in cross section of the paper current handling apparatus shown in FIGS. 1-3.

FIG. 4 is a schematic side elevation in cross section showing the structure of the paper currency handling mechanism 101. This handling mechanism 101 is configured including an upper unit disposed at a higher position and a lower unit disposed at a lower position.

Mechanisms, such as the feeder port 30 and the paper currency identification portion 40, necessary to exchange paper currencies with the user are mainly collected in the upper unit. Specifically, the feeder port 30 through which the user enters and withdraws paper currencies is located in an upper front portion of the paper currency handling mechanism 101. The temporal cash storage 50 capable of once receiving paper currencies entered by the user until a transaction is completed and dispensing paper currencies is disposed in a rear upper stage of the paper currency handling mechanism 101. The paper currency identification portion 40 for identifying paper currencies is disposed between the feeder port 30 and the temporal cash storage 50. A paper currency delivery portion 30*i* for downwardly delivering paper currencies inserted from above via the shutter 101*a* is mounted ahead of a paper currency collecting tray 30*o* for collecting paper currencies conveyed from below in the feeder port 30. The recycling trays 72-74, loading recovery tray 70, and so on are disposed in the lower unit. The operation of the paper currency handling mechanism 101 in the cash insertion mode is now described by referring to FIG. 4. In this mode of operation for depositing money, paper currencies inserted in the paper currency delivery tray 30*i* of the feeder port 30 are temporarily stored in the temporal cash storage 50. Then, the paper currencies are classified according to denomination and received in the recycling trays 72-74 and loading recovery tray 70. In FIG. 4, some arrows indicate the operation for temporarily storing entered paper currencies inserted in the paper currency delivery tray 30*i* in the feeder port 30 into the temporal cash storage 50. The other arrows indicate the operation for classifying the entered paper currencies stored in the temporal cash storage 50 according to denomination and receiving them into the recycling trays 72-74 and loading recovery tray 70.

More specifically, the paper currency handling mechanism control unit 301 controls a gate 50*g* to interconnect a bidirectional transport path 10*e* and a transport path 50*a*. The paper currency handling mechanism control unit 301 controls transport rollers mounted in the transport paths such that the entered paper currencies inserted in the paper currency delivery tray 30*i* of the feeder port 30 are delivered into the transport path 30*a* one by one. As indicated by arrows in the figure, the paper currencies are transported through bidirectional transport paths 10*b* and 10*c* in this order. The paper currencies transported into the bidirectional transport path 10*c* are identified by the paper currency identification portion 40. When entered paper currencies identified by the paper currency identification portion 40 are not rejected paper currencies, the paper currency handling mechanism control unit 301 controls the gate 10*g* to transport the paper currencies along a bidirectional transport path 10*d*, the bidirectional transport path 10*e*, and the transport path 50*a* in turn. The paper currencies are then stacked and stored in the temporal cash storage 50. On the other hand, when entered paper currencies identified by the paper currency identification portion 40 are rejected paper currencies, the paper currency handling mechanism control unit 301 controls the gate 10*g* to interconnect bidirectional transport paths 10*d* and 30*b*. The rejected paper currencies are transported to the transport path 30*b*, collected in the paper currency collector tray 30*o*, and returned to the user.

When all the entered paper currencies are stored in the temporal cash storage 50 and the sum of the entered money is determined, the paper currency handling mechanism control unit 301 controls the gate 25*g* to interconnect the bidirectional transfer path 10*a* and the second bidirectional transfer path 20. The paper currency handling mechanism control unit 301 controls the transfer rollers mounted in the transfer paths to deliver the entered paper currencies stored in the temporal cash storage 50 to the transfer path 50*a* one by one. As indicated by arrows in the figure, the paper currencies are transported through the bidirectional transfer paths 10*e*, 10*d*, and 10*c* in this order. The paper currencies brought to the bidirectional transport path 10*c* are again identified by the paper currency identification portion 40. The identified paper currencies are then transported along the bidirectional transport paths 10*b* and 10*a* in this order by the paper currency handling mechanism control unit 301. Based on the result of the identification made by the paper currency identification portion 40, the paper currency handling mechanism control unit 301 controls gates 74*g*, 73*g*, 72*g*, 71*g*, and 70*g* to receive rejected paper currencies into the rejection tray 71 and receive non-rejected paper currencies into the recycling trays 72-74 or the loading recovery tray 70 after classifying the paper currencies according to denomination. When all entered paper currencies stored in the temporal cash storage 50 are received in the recycling trays 72-74 and loading recovery tray 70, the paper currency handling mechanism control unit 301 finishes the processing for a deposit.

In the present embodiment, the loading recovery tray 70 is also used as a recycling tray. Alternatively, the loading recovery tray 70 may not be used as a recycling tray. In the paper currency handling mechanism 101, the unnoticed paper currency recovery tray 60 may be used as a rejection tray.

Figure 5:
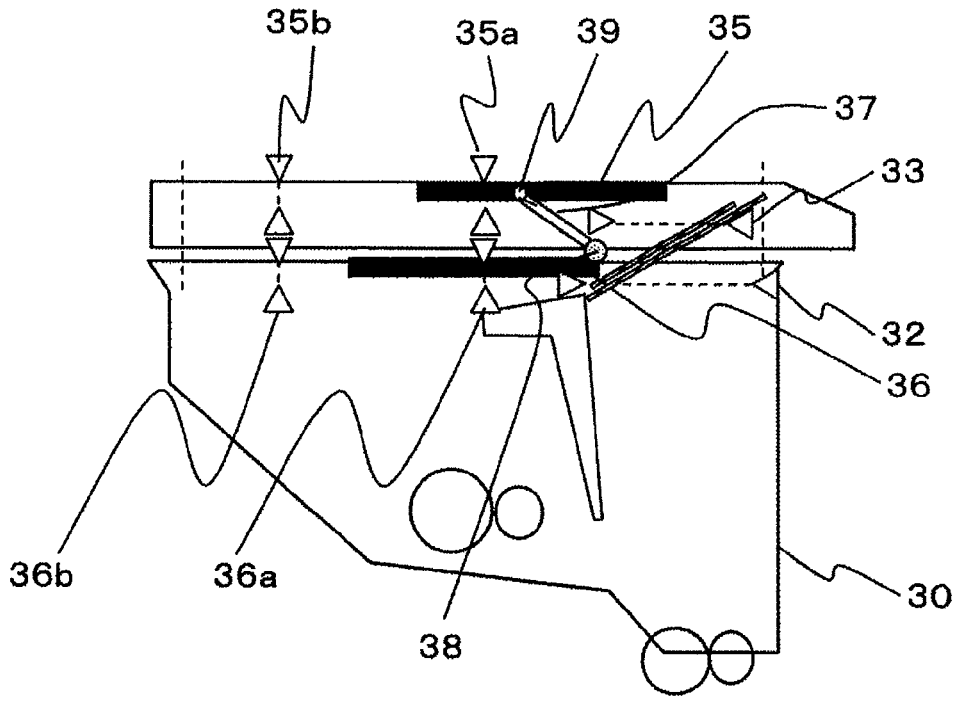
FIGS. 5-7 are side elevations of a feeder port associated with embodiment 1 of the invention, showing different states.
Figure 6:
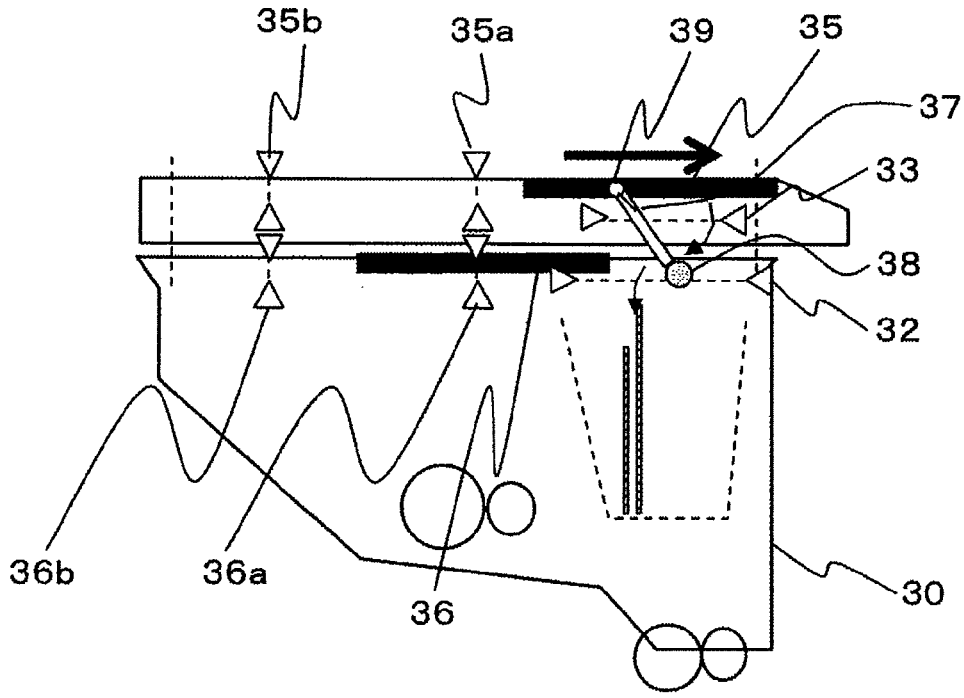
Figure 7:
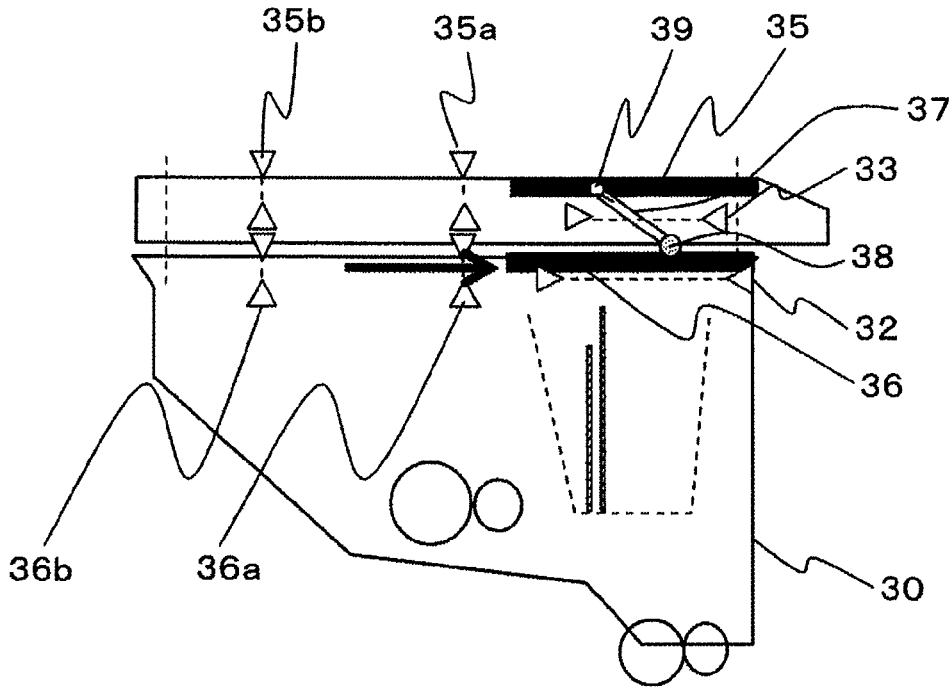

The structure of a double shutter corresponding to the shutter 101*a* is next described by referring to FIGS. 5-7. The double shutter is configured including an outer shutter 35 and an inner shutter 36.

In particular, the outer shutter 35 is disposed above the feeder port 30. The inner shutter 36 is located below the outer shutter 35. A movable lever 37 is mounted to the underside of the outer shutter via a coil spring 39 that is mounted to a shaft (not shown). A roller 38 is mounted to the front end of the movable lever 37 to smoothen the operation when making contact with the inner shutter 36. The roller is mounted to another shaft (not shown) and moved by the coil spring 39 in conformity to the motion of the outer shutter.

In operation, it is assumed that the outer shutter 35 and inner shutter 36 are open as shown in FIG. 6. When the outer shutter 35 is closed, the downward force of the coil spring 39 suppressed by the lower shutter 36 is released, so that the front end of the movable lever 37 is moved downward by the inner shutter 36. At this time, if paper currencies are erroneously entered between the outer shutter 35 and the inner shutter 36, the paper currencies are pushed downward. This permits the paper currencies to be put in the feeder port appropriately. Then, as shown in FIG. 7, the outer shutter 35 is closed. If the inner shutter 36 is closed, the front end of the inner shutter 36 pushes the movable lever 37, raising the front end of the movable lever 37. The roller 38 at the front end of the movable lever 37 rides on the upper surface of the inner shutter 36. The movable lever 37 is loaded between the outer shutter 35 and the inner shutter 36. The provision of the roller 38 at the front end of the movable lever 37 permits the lever 37 to be loaded more smoothly.

When the inner shutter 36 is open but the outer shutter 35 is closed, if the outer shutter 35 is opened, the movable lever 37 moves together with the outer shutter 35 and comes into contact with the front end of the inner shutter 36, thus pushing the movable lever 37. This raises the front end of the movable lever 37. The roller 38 at the front end of the lever 37 rides on the upper surface of the inner shutter 36. The lever 37 is loaded between the outer shutter 35 and the inner shutter 36. Because of this structure, if paper currencies are erroneously entered, the paper currencies can be inserted appropriately without the aid of the user.

Figure 8:
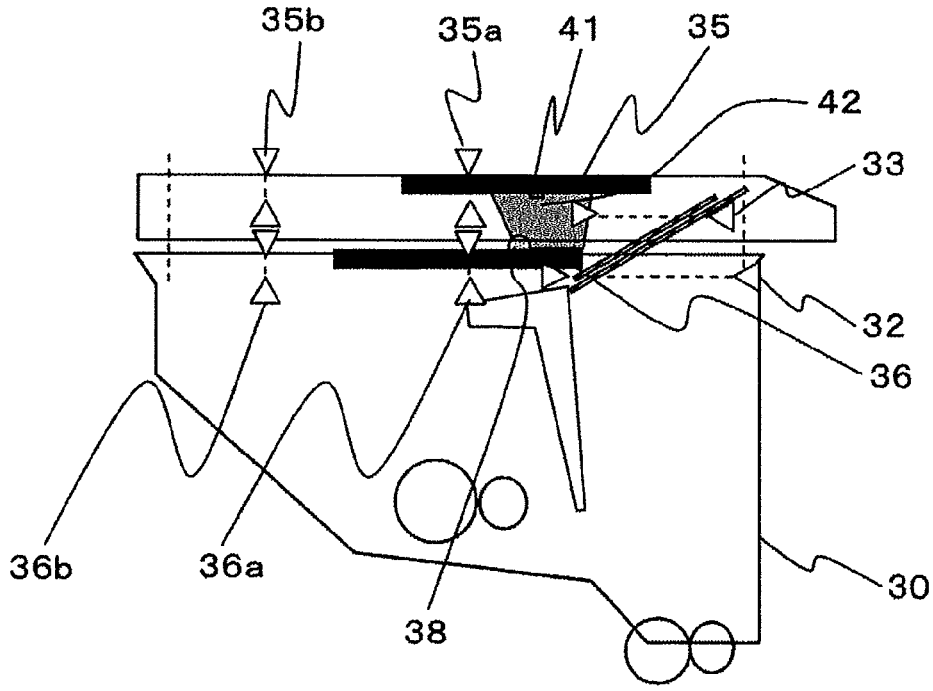
FIGS. 8-10 are side elevations of a feeder port associated with embodiment 2 of the invention, showing different states.
Figure 9:
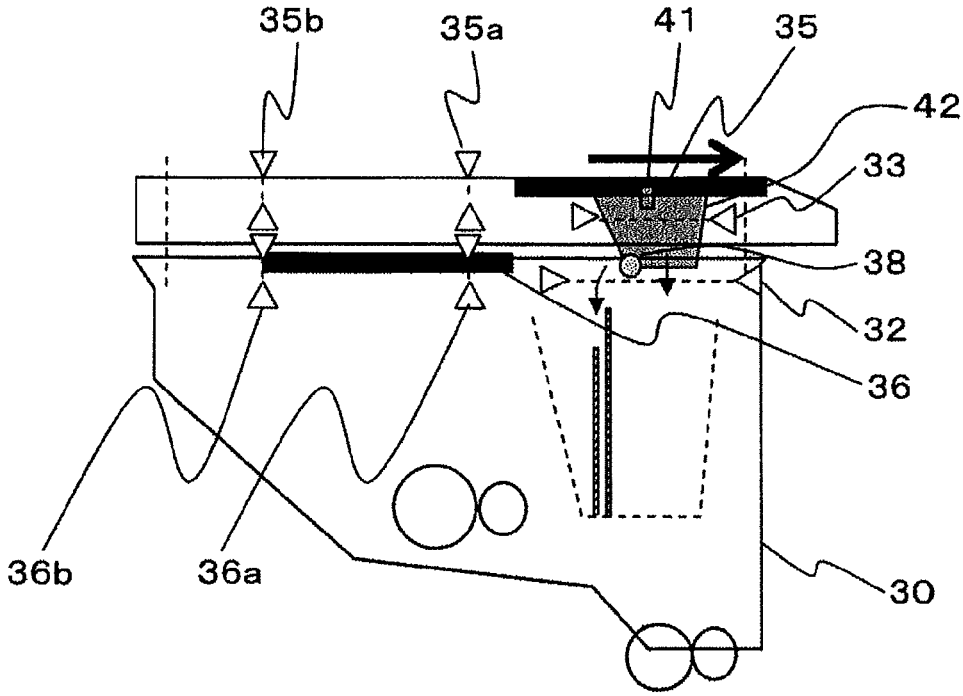
Figure 10:
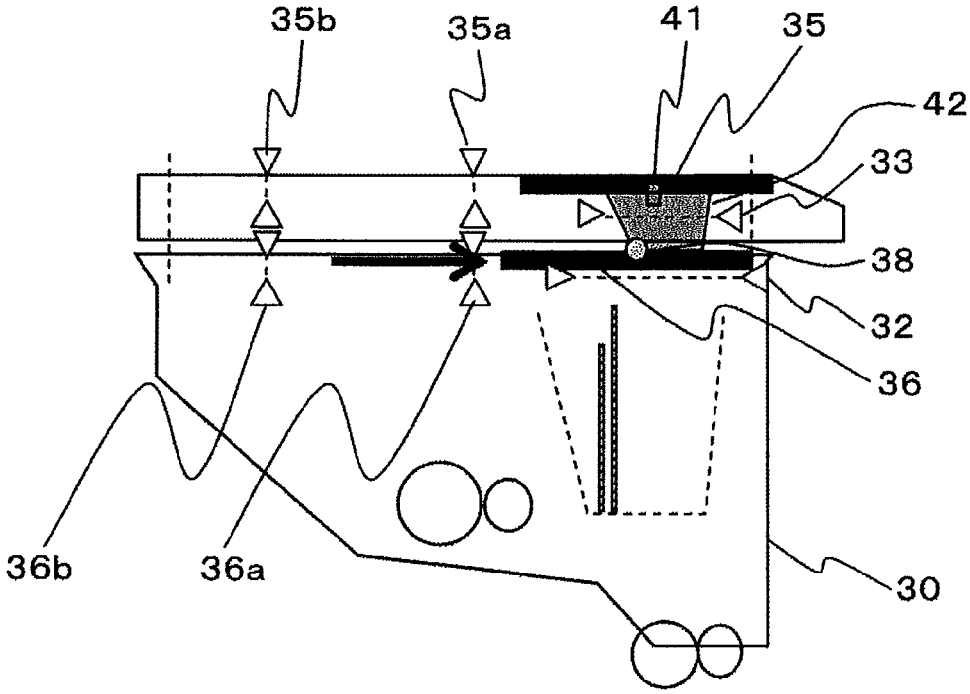

These mechanisms may be configured as shown in FIGS. 8-10 referenced next.

Figure 11:
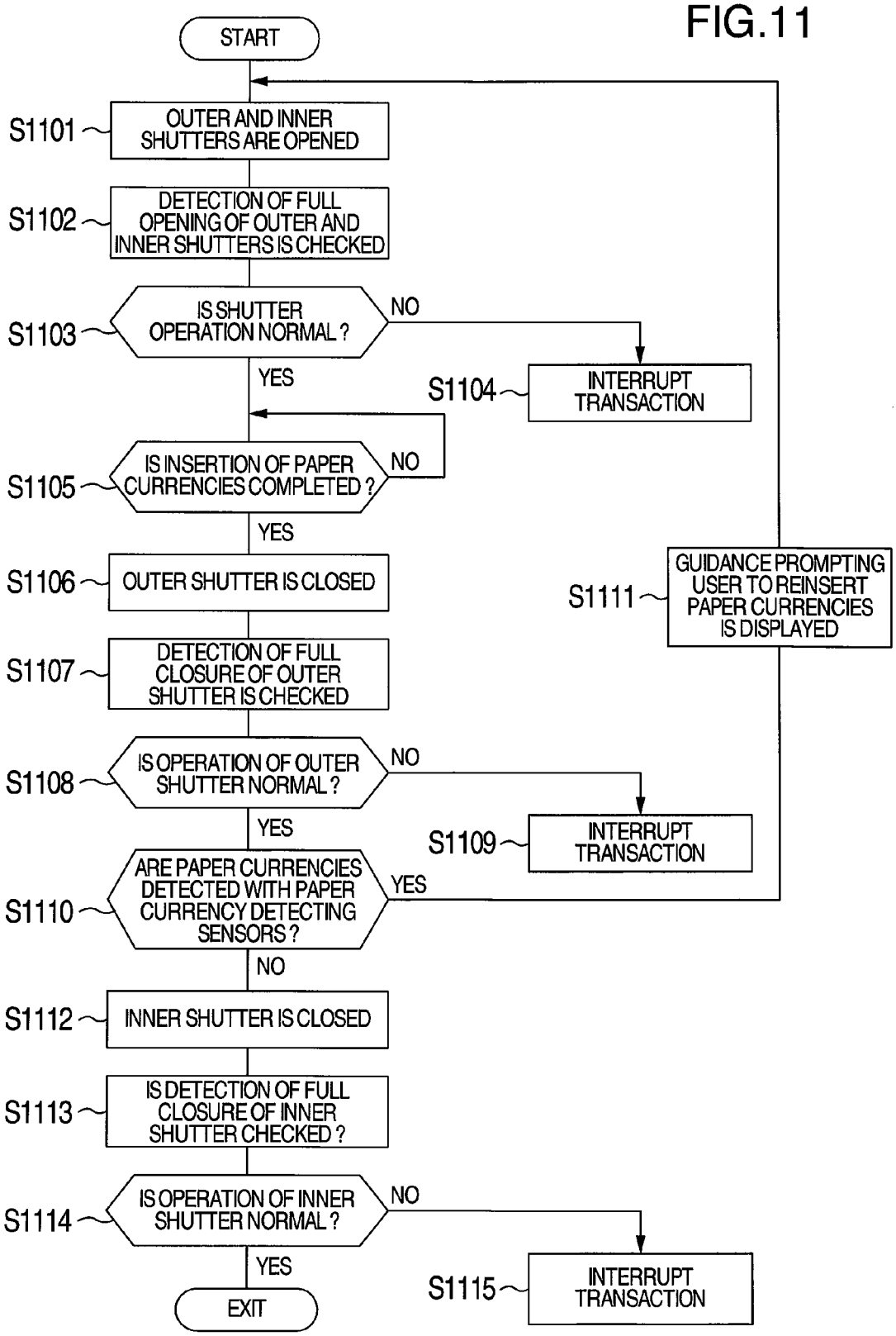
FIG. 11 is a flowchart illustrating a sequence of control operations for an outer shutter and an inner shutter in accordance with an embodiment of the invention.

The flow of processing performed by the configuration described so far is next described by referring to FIG. 11.

FIG. 11 illustrates the flow of processing related to control of the shutters provided by the paper currency handling mechanism control unit 301 during a transaction for depositing money. First, the outer shutter 35 and the inner shutter 36 are driven open by shutter opening/closing unit to permit the user to insert paper currencies into the feeder port 30 (S1101). Then, the state that the outer shutter 35 and inner shutter 36 are open is checked by an outer shutter full opening sensor 35*b* and an inner shutter full opening sensor 36*b* (S1102). A check is made if the outer shutter 35 and inner shutter 36 are operating normally (S1103). At this time, if their operation is judged to be abnormal, an operation for interrupting the transaction is performed (S1104). On the other hand, if the shutters are operating normally, control waits until paper currencies are entered (S1105). If completion of insertion of the paper currencies is detected (S1105), the outer shutter 35 is driven closed (S1106). The decision as to whether or not the insertion of paper currencies is complete is made depending on a method of detecting the presence or absence of paper currencies by a paper currency detection sensor present in the feeder port 30 or on a method of prompting the user to push a shutter-closing button displayed on the user operating portion 105 after the end of insertion of paper currencies. The invention is not restricted to these methods.

If paper currencies are inappropriately inserted between the outer and inner shutters, the paper currencies can be modified to a correct posture and moved to an appropriate location by activating paper currency posture modification unit representing one example of movable lever in response to closing motion of the outer shutter 35.

After checking that the outer shutter full closure sensor 35*a* has detected full closure of the outer shutter 35 (S1107), a check is performed if the operation of the outer shutter 35 is normal (S1108). At this time, if the operation is judged to be abnormal, an operation for interrupting the transaction is performed (S1109). On the other hand, if the result of the decision is that the outer shutter 35 is operating normally, a decision is made as to whether the posture of the inserted paper currencies has been corrected to a normal posture using paper currency posture check sensors 32 and 33 (S1110). More specifically, if no paper currencies are detected by the check sensors 32 and 33, then it is assumed that paper currencies have been appropriately entered in the feeder port, and an operation for closing the inner shutter is performed (S1112). In response to the operation for closing the inner shutter, the paper currency modification unit representing one example of movable lever is loaded between the outer and inner shutters.

After checking that an inner shutter full closure sensor 36*a* detects full closure of the inner shutter 36 (S1113), a check is performed if the inner shutter 36 is operating normally (S1114). At this time, if the operation is judged to be abnormal, an operation for interrupting the transaction is performed (S1115). If the operation is judged to be normal, the transaction is continued.

On the other hand, if paper currencies are detected by the paper currency sensors 32 and 33 at S1110, it is determined that paper currencies have not been entered appropriately. Guidance prompting the user to reinsert the paper currencies is displayed (S1111). The operation for opening the outer and inner shutters is again performed (S1101).

Because of the structure and operation described so far, paper currents in a bad posture can be modified to a correct posture by the movable lever 37 and can be reinserted.

2. Embodiment Using a Movable Guide.

The advantageous effects of the present invention can be achieved if a movable guide 42 as shown in FIG. 8 is provided instead of the movable lever 37 of FIG. 7. In particular, a compression spring 41 is mounted on the lower (rear) side of the outer shutter 35 via a pin. The movable guide 42 is mounted at the front end of the compression spring 41. The roller 38 mounted to the shaft (not shown) is mounted under the movable guide 42. For example, as shown in FIG. 9, when the outer shutter 35 and the inner shutter 36 are both open, if the outer shutter 35 is closed, the downward force of the compression spring 41 compressed by the lower shutter 36 is released, moving the front end of the movable guide 42 to below the inner shutter 36. At this time, if paper currencies are erroneously inserted between the outer shutter 35 and the inner shutter 36, the paper currencies can be appropriately entered into the feeder port by pushing the paper currencies downwardly.

Then, as shown in FIG. 10, when the outer shutter 35 is closed, if the inner shutter 36 is closed, the front end of the inner shutter 36 pushes the movable guide 42, raising the front end of the movable guide 42. The roller 38 at the front end of the movable guide 42 and the guide 42 ride on the upper surface of the inner shutter 36. The movable guide 42 is loaded between the outer shutter 35 and the inner shutter 36. The provision of the roller 38 at the front end of the movable guide 42 permits the movable guide 42 to be loaded more smoothly.

Similarly, when the inner shutter 36 is open while the outer shutter 35 is closed, if the outer shutter 35 is opened, the movable guide 42 moves together with the outer shutter 35 and comes into contact with the front end of the inner shutter 36, pushing the movable guide 42. This raises the movable guide 42. The roller 38 at the front end of the movable guide 42 rides on the upper surface of the inner shutter 36. Consequently, the movable guide 42 is loaded between the outer shutter 35 and the inner shutter 36.

Note that those components of the present embodiment which have not been described in detail are similar or identical with their counterparts of Embodiment 1.

The flow of processing performed by the above-described structure is next described by referring to FIG. 11.

FIG. 11 illustrates the flow of processing related to the operation of the shutters under control of the paper currency handling mechanism control unit 301 during a transaction in which paper currencies are deposited. First, the shutter opening and closing unit drives the outer shutter 35 and the inner shutter 36 open to permit the user to enter paper currencies into the feeder port 30 (S1101). Then, the state in which the outer shutter 35 and inner shutter 36 are open is checked with the outer shutter full opening sensor 35*b* and inner shutter full opening sensor 36*b* (S1102). A decision is performed if the operation of the outer shutter 35 and inner shutter 36 is normal (S1103). If the result of the decision is that the operation is abnormal, the operation for interrupting the transaction is performed (S1104). On the other hand, if the result of the decision is that the operation of the shutters is normal, control waits until paper currencies are entered (S1105). If completion of insertion of the paper currencies is detected (S1105), the outer shutter 35 is driven closed (S1106). The decision as to whether the insertion of the paper currencies is complete is made depending on a method of detecting the presence or absence of paper currencies with the paper currency detecting sensor present in the feeder port 30 or on a method of prompting the user to push the shutter closing button displayed on the user operating portion 105 after the end of insertion of the paper currencies. The invention is not restricted to these methods.

If paper currencies are inappropriately entered between the outer and inner shutters, the paper currencies can be modified to a correct posture and moved into an appropriate location by activating the paper currency posture modification unit representing one example of movable guide in response to closing action of the outer shutter 35.

After full closure of the outer shutter 35 is detected by the outer shutter full closing sensor 35*a* (S1107), a decision is made as to whether the operation of the outer shutter 35 is normal (S1108). At this time, if the result of the decision is that the operation is abnormal, an operation for interrupting the transaction is performed (S1109). On the other hand, if the result of the decision is that the operation of the outer shutter 35 is abnormal, a check is made with the paper currency posture check sensors 32 and 33 as to whether the entered paper currencies have been modified to a normal posture (S1110). In particular, if no paper currencies are detected by the check sensors 32 and 33, then it is determined that paper currencies have been appropriately entered in the feeder port.

Then, an operation for closing the inner shutter is performed (S1112). In response to the operation for closing the inner shutter, the paper currency posture modification unit representing one example of movable guide is loaded between the outer and inner shutters.

After checking that the inner shutter 36 is in its fully closed state using the inner shutter full closure sensor 36*a* (S1113), a decision is made as to whether the operation of the inner shutter 36 is normal (S1114). If the result of the decision is that the operation is normal, the operation for interrupting the transaction is performed (S1115). If the result of the decision is that the operation is normal, the transaction is continued.

On the other hand, if paper currencies are detected by the paper currency detecting sensors 32 and 33 at S1110, it is determined that paper currencies are not entered appropriately. Guidance prompting the user to reinsert the paper currencies is displayed (S1111). The operation for opening the outer and inner shutters is again performed (S1101).

Because of the configuration and operation described so far, if paper currencies are placed in a wrong posture, the movable guide 42 permits the paper currencies to be modified to an appropriate posture and reentered.

It should be further understood by those skilled in the art that although the foregoing description has been made on embodiments of the invention, the invention is not limited thereto and various changes and modifications may be made without departing from the spirit of the invention and the scope of the appended claims.

The invention claimed is:

1. A paper currency handling apparatus comprising:

a feeder port which inserts or dispenses paper currencies by opening or closing an inner shutter and an outer shutter, and the paper currencies are deposited downward from the inner shutter;

a paper currency storage unit which receives the paper currencies;

a transport path which transports the paper currencies between the feeder port and the paper currency storage unit;

an open/close control unit which controls opening/closing operations of the inner shutter and the outer shutter independently; and a paper currency posture modification unit which modifies a posture of the paper currencies present between the outer shutter and the inner shutter, and pushes the paper currencies downward.

2. The paper currency handling apparatus of claim 1, wherein said paper currency posture modification unit is loaded between the outer shutter and the inner shutter as the inner shutter is closed when the outer shutter is already closed, and wherein said paper currency posture modification unit is unloaded from between the outer shutter and the inner shutter as the outer shutter is closed when the inner shutter is already opened.

3. The paper currency handling apparatus of claim 1, wherein when the outer shutter and the inner shutter are open, the outer shutter is driven closed while the inner shutter is kept open.

* * * * *

UNITED STATES PATENT AND TRADEMARK OFFICE

CERTIFICATE OF CORRECTION

PATENT NO. : 8,678,163 B2
APPLICATION NO. : 13/524572
DATED : March 25, 2014
INVENTOR(S) : Tanaka et al.

It is certified that error appears in the above-identified patent and that said Letters Patent is hereby corrected as shown below:

ON THE TITLE PAGE

Please correct (73) as follows:

(73) Assignee: ~~Hitachi Omrom~~ Hitachi-Omron Terminal Solutions, Corp., Tokyo (JP)

Signed and Sealed this
Twenty-fourth Day of June, 2014

Michelle K. Lee

Michelle K. Lee
*Deputy Director of the United States Patent and Trademark Office*